US007517624B2

(12) United States Patent
Mishra et al.

(10) Patent No.: US 7,517,624 B2
(45) Date of Patent: Apr. 14, 2009

(54) IMAGING MEMBER

(75) Inventors: Satchidanand Mishra, Webster, NY (US); Kathleen M. Carmichael, Williamson, NY (US); Satish Parikh, Rochester, NY (US); Anthony M. Horgan, Pittsford, NY (US); Markus R. Silvestri, Fairport, NY (US); Edward F. Grabowski, Webster, NY (US); Kenny-tuan Dinh, Webster, NY (US); Richard L. Post, Penfield, NY (US); Donald J. Goodman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 566 days.

(21) Appl. No.: 11/320,097

(22) Filed: Dec. 27, 2005

(65) Prior Publication Data

US 2007/0148573 A1 Jun. 28, 2007

(51) Int. Cl.
*G03G 9/00* (2006.01)

(52) U.S. Cl. ..... 430/59.6; 399/159

(58) Field of Classification Search ..... 430/59.6; 399/159

See application file for complete search history.

(56) References Cited

U.S. PATENT DOCUMENTS 3,121,006 A 2/1964 Middleton et al.
3,820,989 A 6/1974 Rule et al.
3,837,851 A 9/1974 Shattuck et al.
3,895,944 A 7/1975 Wiedemann et al.
4,150,987 A 4/1979 Anderson et al.
4,233,483 A 11/1980 Turner et al.
4,245,021 A 1/1981 Kazami et al.
4,256,821 A 3/1981 Enomoto et al.
4,265,990 A 5/1981 Stolka et al.
4,278,746 A 7/1981 Goto et al.
4,286,033 A 8/1981 Neyhart et al.
4,291,110 A 9/1981 Lee
4,297,426 A 10/1981 Sakai et al.
4,299,897 A 11/1981 Stolka et al.
4,306,008 A 12/1981 Pai et al.
4,315,982 A 2/1982 Ishikawa et al.
4,338,387 A 7/1982 Hewitt
4,338,388 A 7/1982 Sakai et al.
4,385,106 A 5/1983 Sakai
4,387,147 A 6/1983 Sakai
4,399,207 A 8/1983 Sakai et al.
4,399,208 A 8/1983 Takasu et al.
4,439,507 A 3/1984 Pan et al.
4,587,189 A 5/1986 Hor et al.
4,664,995 A 5/1987 Horgan et al.
4,988,597 A 1/1991 Spiewak et al.
5,244,762 A 9/1993 Spiewak et al.
5,418,099 A * 5/1995 Mayama et al. ..... 430/59.6
5,756,245 A 5/1998 Esteghamatian et al.

(Continued)

OTHER PUBLICATIONS

U.S. Appl. No. 10/744,369, Mishra et al.

*Primary Examiner*—Mark A Chapman
(74) *Attorney, Agent, or Firm*—Pillsbury Winthrop Shaw Pittman LLP

(57) ABSTRACT

The presently disclosed embodiments are directed to charge transport layers useful in electrostatography. More particularly, the embodiments pertain to an electrostatographic imaging member with an improved charge transport layer including a polymeric binder that lowers the surface energy involved and reduces friction.

21 Claims, 2 Drawing Sheets

U.S. PATENT DOCUMENTS 5,830,614 A 11/1998 Pai et al.
6,117,603 A 9/2000 Yu et al.
6,124,514 A 9/2000 Emmrich et al.
6,214,514 B1 4/2001 Evans et al.
6,258,499 B1 * 7/2001 Itami ..... 430/66
6,326,111 B1 12/2001 Chambers et al.
6,548,216 B2 * 4/2003 Kawamura et al. ..... 430/59.6
7,361,440 B2 4/2008 Mishra et al.
2004/0012668 A1 1/2004 Horgan et al.
2004/0018440 A1 1/2004 Lin et al.
2004/0115545 A1 6/2004 Horgan et al.
2004/0126685 A1 * 7/2004 Horgan et al. ..... 430/58.3
2004/0151999 A1 * 8/2004 Mishra et al. ..... 430/58.3
2005/0053854 A1 3/2005 Pai et al.
2005/0136349 A1 6/2005 Mishra et al.
2007/0148575 A1 6/2007 Mishra et al.

* cited by examiner

FIG. 1
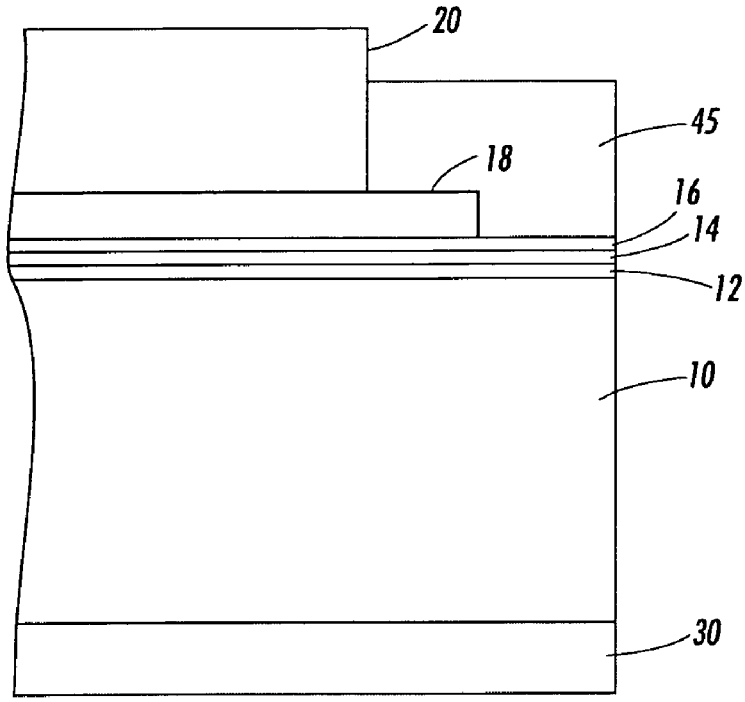
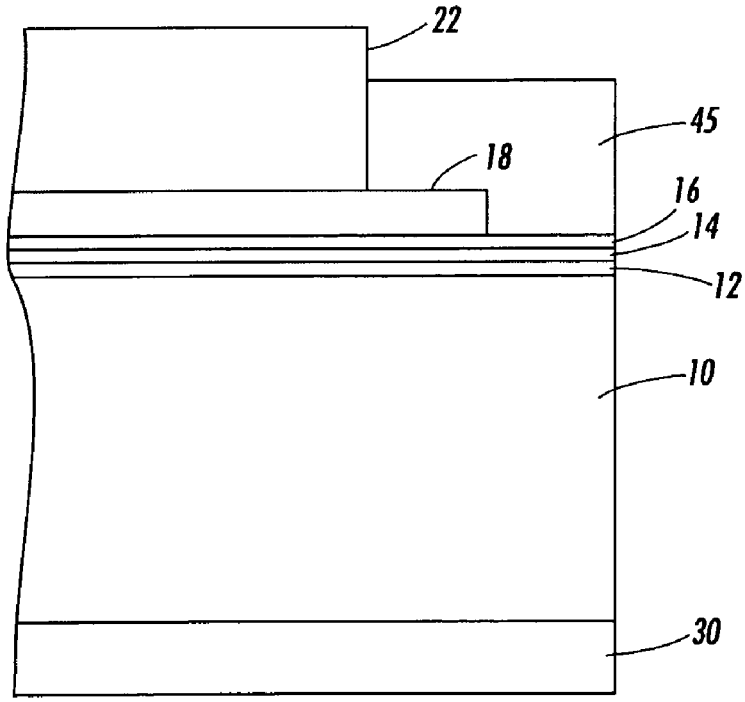
FIG. 2

FIG. 3
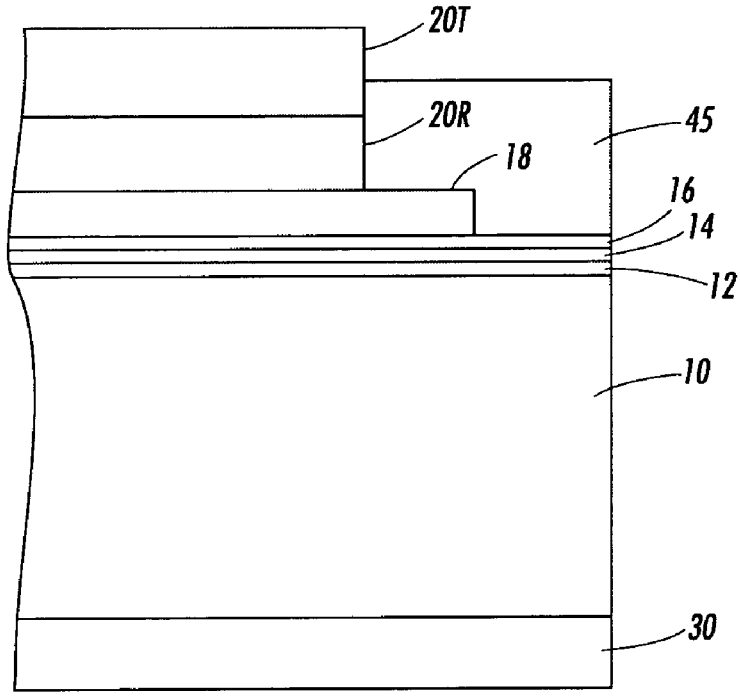
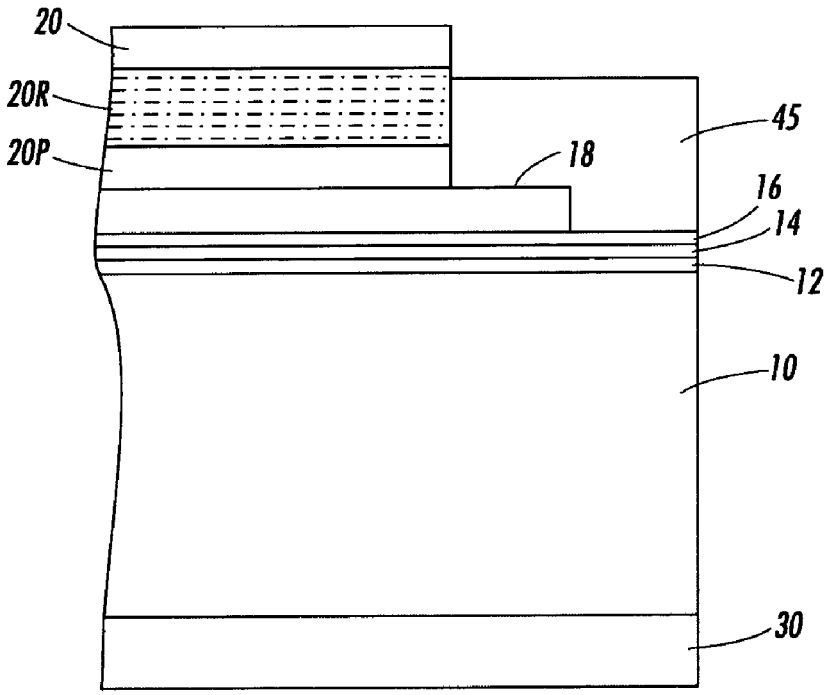
FIG. 4

IMAGING MEMBER

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member with a charge transport layer comprising a polymeric binder that exhibits low surface energy.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

The term "electrostatographic" is generally used interchangeably with the term "electrophotographic." In addition, the terms "charge blocking layer" and "blocking layer" are generally used interchangeably with the phrase "undercoat layer."

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a CGL, a CTL and a conductive ground strip layer adjacent to one edge of the imaging layers, and an optional overcoat layer adjacent to another edge of the imaging layers. Such a photoreceptor may further comprise an anti-curl backing layer on the side of the substrate opposite the side carrying the conductive layer, support layer, blocking layer, adhesive layer, CGL, CTL and other layers.

In a typical machine design, a flexible imaging member belt is mounted over and around a belt support module comprising numbers of belt support rollers, such that the top outermost charge transport layer is exposed to all electrophotographic imaging subsystems interactions. Under a normal machine imaging function condition, the top exposed charge transport layer surface of the flexible imaging member belt is constantly subjected to physical/mechanical/electrical/chemical species actions against the mechanical sliding actions of cleaning blade and cleaning brush, electrical charging devices, corona effluents exposure, developer components, image formation toner particles, hard carrier particles, receiving paper, and the like during dynamic belt cyclic motion. These machine subsystems interaction against the surface of the charge transport layer has been found to consequently cause surface contamination, scratching, abrasion and rapid charge transport layer surface wear problems.

A common problem occurs when the outermost layers of a photoreceptor have high surface energy. The higher surface friction obtained in the high energy surfaces can increase the required torque to drive a belt. Sometimes in large high volume machines using long belts and many backer bars the belt can stall. In addition, high surface energy of the top layer may interact adversely with certain toners. For example, it may become difficult to transfer toner from the photoreceptor to paper or an intermediate transfer belt. Thus, maintaining low surface energy is desirable. The wear of the surface generates powder, which can deposit in the machine and cause problems for other components, for example, dirty the optical elements, and spoil the charge uniformity. Excessive charge transport wear is a serious problem because it causes significant change in the charged field potential to adversely impact copy printout quality. Another consequence of charge transport layer wear is the decrease of charge transport layer thickness to alter the equilibrium of the balancing forces between the charge transport layer and the anti-curl backing layer and impact imaging member belt flatness. The reduction of charge transport layer by wear thereby causes the imaging member belt to exhibit downward curling at both edges when the belt functions in a machine. Since edge curling in the belt is an important issue changes the distance between the belt surface and the charging device(s), causing non-uniform surface charging density which does also manifest itself in "smile" print defect in receiving paper copies. Such a print defect is characterized by lower intensity of print-images at the locations over both belt edges. Further, the interaction against developer carrier beads and hard particulate from paper debris which may scratch the surface of the photoreceptor has also been identified to be a major imaging member functional failure, since the scratches may manifest themselves into print defects. Thus lowering the surface energy is always a desired goal.

The CTLs of photoreceptors used in current web-based and drum-based machines commonly use MAKROLON or PCZ-300 or PCZ-400 as a polycarbonate binder for the transport molecule. However, these common materials have drawbacks associated with high energy polymer discussed previously. Particularly, in a rigid electrophotographic imaging member drum design utilizing a contact AC Bias Charging Roller (BCR), attack by ozone species on the charge transport layer polymer binder is more pronounced because of the close vicinity of the BCR to the charge transport layer of the imaging member drum. Moreover, in some machines the electrostatic charge builds up due to a high friction coefficient against the cleaning blades which leads to increased torque and scratching problems. These problems can also contribute to future cleaning problems of chemical toners.

Many attempts have been made to overcome the above problems but not without leading to additional problems. For example, in the past, micro particles such as polytetrafluoroethylene (PTFE) and silica have been dispersed in polymeric binders to alleviate the above problems. However, such particles have a stability issue. PTFE forms an unstable dispersion and tends to settle in the mix tanks if not continuously stirred. Non-uniform distribution of PTFE in the CTL can lead to electrical non-uniformity and associate print defects. Also, mixtures of polymers may cause problems of incompatability in solution and phase separation upon drying of the CTL.

Thus, electrostatographic imaging members comprising a supporting substrate, having a conductive surface on one side, coated over with at least one photoconductive layer, may exhibit deficiencies which are undesirable in advanced automatic, cyclic electrostatographic copiers, duplicators, and printers. While the above mentioned electrostatographic imaging members may be suitable for their intended purposes, further improvement on the electrostatographic systems are needed. For example, there continues to be the need for improvements in photoreceptors, particularly for an improved imaging member that substantially alleviates problems from high surface energy.

Imaging members involving low surface energy materials are illustrated in commonly assigned U.S. Patent Application Publication No. 2007/0148575 entitled "Improved Imaging Member," to Mishra et al., filed Dec. 27, 2005, and commonly assigned U.S. patent application Ser. No. 11/199,842, filed Aug. 9, 2005, to Mishra et al., entitled "Anti-curl Backing Layer for Electrostatographic Imaging Members," now U.S. Pat. No. 7,361,440." The disclosures of these applications are hereby incorporated by reference in their entirety.

REFERENCES

The following patents, the disclosure of which are incorporated in their entireties by reference, are mentioned: U.S. Pat. No., 4,265,990 illustrates a layered photoreceptor having a separate charge generating layer and a separate CTL. The charge generating layer is capable of photogenerating holes and injecting the photogenerated holes into the CTL. The photogenerating layer utilized in multilayered photoreceptors includes, for example, inorganic photoconductive particles or organic photoconductive particles dispersed in a film forming polymeric binder. Examples of photosensitive members having at least two electrically operative layers including a charge generating layer and a diamine containing transport layer are disclosed in U.S. Pat. Nos. 4,233,384; 4,306,008; 4,299,897; and, 4,439,507, the disclosures of each of these patents being totally incorporated herein by reference in their entirety.

U.S. Pat. No. 6,117,603 discloses an electrophotographic imaging member including a supporting substrate having an electrically conductive outer surface and at least a one layer having an exposed imaging surface, the CTL, including a continuous matrix comprising a film forming polymer and a surface energy lowering liquid polysiloxane.

U.S. Pat. No. 6,326,111 relates to a charge transport material for a photoreceptor including at least a polycarbonate polymer, at least one charge transport material, polytetrafluoroethylene (PTFE) particle aggregates having an average size of less than about 1.5 microns, hydrophobic silica and a fluorine-containing polymeric surfactant dispersed in a solvent. The presence of the hydrophobic silica enables the dispersion to have superior stability by preventing settling of the PTFE particles. A resulting CTL produced from the dispersion exhibits excellent wear resistance against contact with an AC bias charging roll, excellent electrical performance, and delivers superior print quality.

U.S. Pat. No. 5,830,614 relates to a charge transport having two layers for use in a multilayer photoreceptor. The photoreceptor comprises a support layer, a charge generating layer, and two CTLs. The CTLs consist of a first transport layer comprising a charge transporting polymer (consisting of a polymer segment in direct linkage to a charge transporting segment) and a second transport layer comprising a same charge transporting polymer except that it has a lower weight percent of charge transporting segment than that of the first CTL. In the '614 patent, the hole transport compound is connected to the polymer backbone to create a single giant molecule of hole transporting polymer.

Application Ser. No. 10/744,369. filed on Dec. 23, 2003 relates to an electrophotographic imaging member having a charge generating layer and a charge transport layer overlayed thereon is provided. The charge transport layer has a lower surface and an upper surface, wherein the lower surface is in contiguous contact with the charge generating layer. The charge transport layer comprises a film forming polymer binder and a charge transport compound molecularly dispersed or dissolved therein to form a solid solution. The concentration of the charge transport compound in the charge transport layer decreases from the lower surface to the upper surface. In such a construction, the resulting charge transport layer exhibits enhanced cracking suppression, improved wear resistance, excellent imaging member electrical performance, and improved copy print out quality.

SUMMARY

According to aspects illustrated herein, there is provided a charge transport layer that addresses the shortcomings of traditional imaging members discussed above. These compositions and processes are related to a mechanically robust charge transport layer, which enhances abrasion, scratch, and wear resistance and reduces formation of films on the exposed surface to toner and developer and thus increase life of the imaging member under normal machine functions.

An embodiment may include an electrostatographic imaging member comprising a substrate having a first and second side, wherein the substrate has a conductive surface, and an imaging layer disposed on the first side of the substrate, wherein the imaging layer comprises a polymeric binder formed from a monomer selected from the group consisting of modified Bisphenol A polycarbonate poly(4,4'-isopropylidene diphenyl carbonate), modified Bisphenol Z polycarbonate poly (4,4'-diphenyl-1-1'cyclohexane carbonate), and mixtures thereof.

A further embodiment may include an electrostatographic imaging member comprising a substrate having a first and second side, wherein the substrate has a conductive surface, and a charge transport layer disposed on the first side of the substrate, wherein the charge transport layer comprises a polymeric binder formed from a monomer selected from the group consisting of modified Bisphenol A polycarbonate poly (4,4'-isopropylidene diphenyl carbonate), modified Bisphenol Z polycarbonate poly (4,4'-diphenyl-1-1'cyclohexane carbonate), and mixtures thereof.

In still another embodiment, there is provided an image forming apparatus for forming images on a recording medium comprising an electrostatographic imaging member having a charge retentive-surface to receive an electrostatic latent image thereon, wherein the electrostatographic imaging member comprises a substrate having a first and second side, wherein the substrate has a conductive surface, and an imaging layer disposed on the first side of the substrate, wherein the imaging layer includes a polymeric binder formed from a monomer selected from the group consisting of modified Bisphenol A polycarbonate poly(4,4'-isopropylidene diphenyl carbonate), modified Bisphenol Z polycarbonate poly (4,4'-diphenyl-1-1'cyclohexane carbonate), and mixtures thereof, a development member for applying a developer material to the charge-retentive surface to develop the electrostatic latent image to form a developed image on the charge-retentive surface, a transfer member for transferring the developed image from the charge-retentive surface to an intermediate transfer member or a copy substrate, and a fusing member for fusing the developed image to the copy substrate.

A further embodiment, the charge transport layer is a dual-layer comprising a bottom charge transport layer comprises a film forming polymer and a charge transport compound and a different low surface energy top charge transport layer over the bottom layer.

In an alternative embodiment, the low surface energy top charge transport layer comprises plurality of layers containing low surface energy polymer in an ascending amount to reach a maximum at the outermost top layer; alternatively, the outermost top layer may contain only pure low surface energy polymer.

In another embodiment, a process for making an electrophotographic imaging member, and a specific process for making such a charge transport layer and/or imaging member comprising the same is disclosed

BRIEF DESCRIPTION OF THE DRAWINGS

For a better understanding, reference may be had to the accompanying figures.

FIG. 1 is a cross-sectional view of a multilayered electrophotographic imaging member where the charge transport layer is a single layer according to one embodiment.

FIG. 2 is a cross-section view of a multilayered electrophotographic imaging member according to another embodiment.

FIG. 3 is a schematic cross-sectional view of another exemplary embodiment in which the imaging member contains dual charge transport layers.

FIG. 4 is a schematic cross-sectional view of an additional exemplary embodiment of an imaging member. The imaging member, as illustrated, comprises multiple charge transport layers.

DETAILED DESCRIPTION

In the following description, reference is made to the accompanying drawings, which form a part hereof and which illustrate several embodiments. It is understood that other embodiments may be utilized and structural and operational changes may be made without departure from the scope of the present disclosure.

The presently disclosed embodiments are directed generally to layers useful in imaging apparatus components, such as an imaging member, that exhibit low surface energy. In a typical electrostatographic reproducing apparatus such as electrophotographic imaging system using a photoreceptor, a light image of an original to be copied is recorded in the form of an electrostatic latent image upon a photosensitive member and the latent image is subsequently rendered visible by the application of a developer mixture. The developer, having toner particles contained therein, is brought into contact with the electrostatic latent image to develop the image on an electrostatographic imaging member which has a charge-retentive surface. The developed toner image can then be transferred to a copy substrate, such as paper, that receives the image via a transfer member.

The exemplary embodiments of this disclosure are described below with reference to the drawings. The specific terms are used in the following description for clarity, selected for illustration in the drawings and not to define or limit the scope of the disclosure. The same reference numerals are used to identify the same structure in different Figures unless specified otherwise. The structures in the figures are not drawn according to their relative proportions and the drawings should not be interpreted as limiting the disclosure in size, relative size, or location. In addition, though the discussion will address negatively charged systems, the imaging members of the present disclosure may also be used in positively charged systems.

An exemplary embodiment of a multilayered electrophotographic imaging member of flexible belt configuration is illustrated in FIG. 1. The exemplary imaging member includes a support substrate 10 having an optional conductive surface layer or layers 12 (which may be referred to herein as a ground plane layer), optional if the substrate itself is conductive, a hole blocking layer 14, an optional adhesive interface layer 16, a charge generating layer 18 and a charge transport layer 20. The charge generating layer 18 and the charge transport layer 20 forms an imaging layer described here as two separate layers. It will be appreciated that the functional components of these layers may alternatively be combined into a single layer.

Other layers of the imaging member may include, for example, an optional ground strip layer 45, applied to one edge of the imaging member to promote electrical continuity with the conductive layer 12 through the hole blocking layer 14. An anti-curl backing layer 30 of the photoreceptor may be formed on the backside of the support substrate 10. The conductive ground plane 12 is typically a thin metallic layer, for example a 10 nanometer thick titanium coating, deposited over the substrate 10 by vacuum deposition or sputtering process. The layers 14, 16, 18, and 20 may be separately and sequentially deposited on to the surface of conductive ground plane 12 of substrate 10 as solutions comprising a solvent, with each layer being dried before deposition of the next. The ground strip layer 45 may be applied after coating these layers or simultaneously with the CTL.

As an alternative to separate charge transport 20 and charge generation layers 18, a single imaging layer 22 may be employed, as shown in FIG. 2, with other layers of the photoreceptor being formed as described below.

In the exemplary embodiment of FIG. 3, the CTL comprises a dual charge transport layer 20L and 20T, a first or bottom charge transport layer 20L being in contact with the charge generator layer 18, with the top layer 20T being the outermost layer. The dual transport layer 20L and 20T may have same or different composition and thickness.

In the exemplary embodiment of FIG. 4 the CTL comprises a bottom CTL 20P, one or more intermediate charge transport layers 20R, and a last or outermost charge transport layer 20S at the very top. Each intermediate layer of the composite CTL 20R may have the same or different composition as the other layers, but the outermost charge transport layer 20S has the lowest surface energy. The topmost layer in the CTL in these exemplary embodiments 20, 22, 20T or 20S is the outermost layer of the imaging member, and is therefore is exposed to the operating environment of the machine.

The Substrate

The photoreceptor support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and/or oxides.

The substrate 10 can also be formulated entirely of an electrically conductive material, or it can be an insulating material including inorganic or organic polymeric materials, such as MYLAR, a commercially available biaxially oriented polyethylene terephthalate from DuPont, or polyethylene naphthalate available as KALEDEX 2000, with a ground plane layer 12 comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations.

The substrate 10 may have a number of many different configurations, such as for example, a plate, a cylinder, a drum, a scroll, an endless flexible belt, and the like. In the case of the substrate being in the form of a belt, the belt can be seamed or seamless.

The thickness of the substrate 10 depends on numerous factors, including flexibility, mechanical performance, and economic considerations. The thickness of the support substrate 10 may range from about 25 micrometers to about 3,000 micrometers. In embodiments of flexible photoreceptor belt preparation, the thickness of substrate 10 is from about 50 micrometers to about 200 micrometers for optimum flexibility and to effect minimum induced photoreceptor surface bending stress when a photoreceptor belt is cycled around small diameter rollers in a machine belt support module, for example, 19 millimeter diameter rollers.

An exemplary substrate support 10 is not soluble in any of the solvents used in each coating layer solution, is optically transparent or semi-transparent, and is thermally stable up to a high temperature of about 150° C. A typical substrate support 10 used for imaging member fabrication has a thermal contraction coefficient ranging from about $1\times10^{-5}$ per ° C. to about $3\times10^{-5}$ per ° C. and a Young's Modulus of between about $5\times10^{-5}$ psi ($3.5\times10^{-4}$ Kg/cm2) and about $7\times10^{-5}$ psi ($4.9\times10^{-4}$ Kg/cm2).

The Conductive Layer

The conductive ground plane layer 12 may vary in thickness depending on the optical transparency and flexibility desired for the electrophotographic imaging member. When a photoreceptor flexible belt is desired, the thickness of the conductive layer 12 on the support substrate 10, for example, a titanium and/or zirconium conductive layer produced by a sputtered deposition process, typically ranges from about 2 nanometers to about 75 nanometers to allow adequate light transmission for proper back erase, and in embodiments from about 10 nanometers to about 20 nanometers for an optimum combination of electrical conductivity, flexibility, and light transmission. Generally, for rear erase exposure, a conductive layer light transparency of at least about 15 percent is desirable. The conductive layer need not be limited to metals. The conductive layer 12 may be an electrically conductive metal layer which may be formed, for example, on the substrate by any suitable coating technique, such as a vacuum depositing or sputtering technique. Typical metals suitable for use as conductive layer 12 include aluminum, zirconium, niobium, tantalum, vanadium, hafnium, titanium, nickel, stainless steel, chromium, tungsten, molybdenum, combinations thereof, and the like. Where the entire substrate is an electrically conductive metal, the outer surface can perform the function of an electrically conductive layer and a separate electrical conductive layer may be omitted. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The illustrated embodiment will be described in terms of a substrate layer 10 comprising an insulating material including inorganic or organic polymeric materials, such as, MYLAR with a ground plane layer 12 comprising an electrically conductive material, such as titanium or titanium/zirconium, coating over the substrate layer 10.

The Hole Blocking Layer

An optional hole blocking layer 14 may then be applied to the substrate 10 or to the layer 12, where present. Any suitable positive charge (hole) blocking layer capable of forming an effective barrier to the injection of holes from the adjacent conductive layer 12 into the photoconductive or charge generating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer should be continuous and may have a thickness in a wide range of from about 0.2 microns to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula [H2N(CH2)4]CH3Si(OCH3)2, and (gamma-aminopropyl) methyl diethoxysilane, which has the formula [H2N(CH2)3]CH33Si(OCH3)2, and combinations thereof, as disclosed, for example, in U.S. Pat. Nos. 4,338,387; 4,286,033; and 4,291,110, incorporated herein by reference in their entireties. An embodiment of a hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate).

The blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The interface layer may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-100, VITEL PE-200, VITEL PE-200D, and VITEL PE-222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. In yet other embodiments, the adhesive interface layer 16 is entirely omitted.

Any suitable solvent or solvent mixtures may be employed to form a coating solution of the polyester for the adhesive interface layer 16. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The charge generating layer 18 may thereafter be applied to the adhesive layer 16. Any suitable charge generating binder including a charge generating/photoconductive material, which may be in the form of particles and dispersed in a film forming binder, such as an inactive resin, may be utilized. Examples of charge generating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous charge generating layer. Benzimidazole perylene compositions are well known and described, for example, in U.S. Pat. No. 4,587,189, the entire disclosure thereof being incorporated herein by reference. Multi-charge generating layer compositions may be utilized where a photoconductive layer enhances or reduces the properties of the charge generating layer. Other suitable charge generating materials known in the art may also be utilized, if desired. The charge generating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the charge generating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like. Another film-forming polymer binder is PCZ-400 (poly (4,4'-dihydroxy-diphenyl-1-1-cyclohexane) which has a viscosity-molecular weight of 40,000 and is available from Mitsubishi Gas Chemical Corporation.

The charge generating material can be present in the resinous binder composition in various amounts. Generally, from about 5 percent by volume to about 90 percent by volume of the charge generating material is dispersed in about 10 percent by volume to about 95 percent by volume of the resinous binder, and more specifically from about 20 percent by volume to about 60 percent by volume of the charge generating material is dispersed in about 40 percent by volume to about 80 percent by volume of the resinous binder composition.

The charge generating layer 18 containing the charge generating material and the resinous binder material generally ranges in thickness of from about 0.1 micrometer to about 5 micrometers, for example, from about 0.3 micrometers to about 3 micrometers when dry. The charge generating layer thickness is generally related to binder content. Higher binder content compositions generally employ thicker layers for charge generation.

The Charge Transport Layer

The charge transport layer 20 is thereafter applied over the charge generating layer 18 and may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and no charge generation when exposed to a wavelength of light useful in xerography, e.g., 400 to 900 nanometers. In the case when the photoreceptor is prepared with the use of a transparent substrate 10 and also a transparent or partially transparent conductive layer 12, image wise exposure or erase may be accomplished through the substrate 10 with all light passing through the back side of the substrate. In this case, the materials of the layer 20 need not transmit light in the wavelength region of use if the charge generating layer 18 is sandwiched between the substrate and the charge transport layer 20. The charge transport layer 20 in conjunction with the charge generating layer 18 is an insulator to the extent that an electrostatic charge placed on the charge transport layer is not conducted in the absence of illumination. The charge transport layer 20 should trap minimal charges as the charge passes through it during the discharging process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photogenerated holes from the charge generation material and incapable of allowing the transport of these holes through. This addition converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

While any suitable inactive resin binder soluble in methylene chloride, chlorobenzene, or other suitable solvent may be employed in the charge transport layer, it has been shown that use of a particular modified polycarbonate polymer exhibiting low surface energy results in better performance of the electrostatographic imaging member.

A polymer with lower surface energy than that of materials currently used in charge transport layers, such as for example MAKROLON, PCZ-300 or PCZ-400, can reduce printing problems in the larger printing apparatuses. The use of such a polymer will substantially eliminate the need for PTFE, silica or other such materials, in charge transport layer formulations. Furthermore, the polymer can act as a single polymeric binder that considerably eliminates the need for other additives in the charge transport layer to adequately lower the coefficient of friction, and in the larger printing apparatuses, can largely remove the need for additional members or components, subsequently reducing the cost of the photoreceptor.

The polymer commonly used in the art is a bisphenol A based polymer. Embodiments of the present photoreceptor include four copolymers of various viscosity-molecular weights and surface energies. All of these copolymers have surface energy less than currently used polymers, such as MAKROLON, as shown by measurements via contact angle measurements shown below in Table 1 of Example I. The contact angle, q, is a quantitative measure of the wetting of a solid by a liquid. It is defined geometrically as the angle formed by a liquid at the three phase boundary where a liquid, gas and solid intersect. Another way to characterize a solid surface is by calculating free surface energy, also referred to as "solid surface tension." This approach involves testing the particular solid against a series of well-characterized wetting liquids. The liquids used must be characterized such that the polar and dispersive components of their surface tensions are known.

Each of the four copolymers may be obtained from Mitsubishi Gas Chemical Corporation (Tokyo, Japan), and referred to as FPC0540UA, FPC0550UA, FPC0580UA, and FPC0170UA. The low surface energy polymers are modified Bisphenol A polycarbonate poly(4,4'-isopropylidene diphenyl carbonate) or a modified Bisphenol Z polycarbonate poly (4,4'-diphenyl-1-1'cyclohexane carbonate) or mixtures thereof and having a range of viscosity-molecular weights of from about 20,000 to about 150,000, or from about 39,000 to about 76,000. Depending on viscosity-molecular weight and concentration in the solution, viscosities cover a wide range including values equivalent to solutions of current polymers such as MAKROLON. Viscosity of the polymer solution may impact the particular method of extrusion coating the charge transport layer onto the photoreceptor Coating defects caused from using low viscosity solutions include Maragoni Cells, mottle, runback, streaks, nonuniform thickness across the width of the web, and the like.

The charge transport layer of this photoreceptor is applied over the charge generation layer. The compositions for charge transport layers are well known in the art and may comprise thermoplastic organic polymers or inorganic polymers that are electrically insulating or slightly semi-conductive.

Any suitable and conventional technique may be utilized to form and thereafter apply the charge transport layer mixture to the supporting substrate layer. Typical application techniques include, for example extrusion coating, draw bar coating, roll coating, wire wound rod coating, and the like. The charge transport layer may be formed in a single coating step or in multiple coating steps.

Drying of the deposited coating may be effected by any suitable conventional technique such as oven drying, infra red radiation drying, air drying and the like. The thickness of the charge transport layer after drying is from about 10 micrometers to about 40 micrometers or from about 24 micrometers to about 34 micrometers for optimum photoelectrical and mechanical results.

In one embodiment, the charge transport layer 20 may be comprised of the low surface energy polymer being a modified Bisphenol A polycarbonate poly(4,4'-isopropylidene diphenyl carbonate) or a modified Bisphenol Z polycarbonate poly (4,4'-diphenyl-1-1'cyclohexane carbonate) and having a range of viscosity-molecular weights of from about 20,000 to about 150,000, or from about 39,000 to about 76,000 (available from Mitsubishi Gas Chemical Co.) and a charge transport component. Bisphenol Z and bisphenol A are chemical building blocks that are used primarily to make polycarbonate plastic and epoxy resins. Solvents such as methylene chloride, monochlorobenzene, tetrahydofuran, or toulene may be used in embodiments.

A generic charge transport layer formulation has a ratio of polymer to charge transport component between about 30:70 to about 70:30, or about 50:50 dissolved at about 15 percent by weight in a solvent, such as but not limited to, methylene chloride. Specifically, the formulation may be about 50:50 ratio of the low surface energy polymer to the charge transport component. The polymer binder may also be present in an amount of from about 5% to about 70% or from about 30% to about 70% by weight of total weight of the imaging layer. The low surface energy polymer being, for example, the modified polycarbonate polymers described herein. In alternative embodiments, the polymer to charge transport component ratio may be changed and the weight percentage of solids dissolved in the solvent may also be changed.

In an embodiment, the charge transport layer can be a dual-layer comprising a bottom charge transport layer which comprises a film forming polymer and a charge transport compound and a different low surface energy top charge transport layer over the bottom layer. In some embodiments, the bottom layer has a higher weight ratio of charge transport compound than the top layer with the weight ratio being based on the total weight of the charge transport layer. In yet other embodiments, the charge transport layer includes a top and bottom layer with the top and bottom layer being in contact with the charge generating layer. In this embodiment, then weight percent of the polymeric binder to the charge transport compound in the one or more intermediate layers increases in the direction of the bottom layer to the outermost layer with the weight percent of polymeric binder in the outermost layer is greater than the weight percent of every other intermediate layer. The weight percent is based on the total weight of the intermediate layers.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines; (N,N'-diphenyl-N,N'-bis[3-methylphenyl]-[1,1'-biphenyl]-4,4'-diamine); N,N'-diphenyl-N,N'-bis(chlorophenyl)-1,1'-biphenyl-4,4'-diamine; and N,N'-bis-(4-methylphenyl)-N,N'-bis(4-ethylphenyl)-1,1'-3,3'-dimethylbiphenyl)-4,4'-diamine, N,N'-bis-(3,4-dimethylphenyl)-4,4'-biphenyl amine, and combinations thereof.

Other suitable charge transport components include pyrazolines, such as 1-[lepidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein by reference in their entireties.

The concentration of the charge transport component in layer 20 may be, for example, at least about 5 weight % and may comprise up to about 60 weight %. The concentration or composition of the charge transport component may vary through layer 20, as described, for example, in U.S. application Ser. No. 10/736,864, filed Dec. 16, 2003, entitled "Imaging Members," by Anthony M. Horgan, et al., which was published on Jul. 1, 2004, as Application Serial No. 2004/0126684; U.S. application Ser. No. 10/320,808, filed Dec. 16, 2002, entitled "Imaging Members," by Anthony M. Horgan, et al., which was published on Jun. 17, 2004, as Application Serial No. 2004/0115545, and U.S. application Ser. No. 10/655,882, filed Sep. 5, 2003, entitled "Dual charge transport layer and photoconductive imaging member including the same," by Damodar M. Pai, et al., which was published on Mar. 10, 2005 as application Ser. No. 2005/0053854, the disclosures of which are incorporated herein by reference in their entireties.

In one exemplary embodiment, the charge transport layer 20 comprises an average of about 10-60 weight % N,N'-diphenyl-N,N'-bis(3-methylphenyl)-1,1'-biphenyl-4,4'-diamine, such as from about 30-50 weight % N,N'-diphenyl-N,N'-bis(3-methylphenyl)-1,1'-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hydroxyhydrociannamate, available as IRGANOX I-1010 from Ciba Specialty Chemicals. The hindered phenol may be present as up to about 10 weight percent based on the concentration of the charge transport component. Other suitable antioxidants are described, for example, in above-mentioned U.S. application Ser. No. 10/655,882 incorporated by reference.

In one specific embodiment, the charge transport layer 20 is a solid solution including a charge transport component, such as N,N'-diphenyl-N,N'-bis(3-methylphenyl)-1,1'-biphenyl-4,4'-diamine, molecularly dissolved in a polycarbonate binder, the binder being formed from a monomer selected from the group consisting of modified Bisphenol A polycarbonate poly(4,4'-isopropylidene diphenyl carbonate) and a modified Bisphenol Z polycarbonate poly(4,4'-diphenyl-1-1'cyclohexane carbonate) and having a viscosity-molecular weight of from about 20,000 to about 150,000, or from about 39,000 to about 76,000.

The total thickness of the composite charge transport layer 20 in other embodiments can be from about 5 micrometers to about 50 micrometers, e.g., from between about 15 micrometers and about 40 micrometers. The charge transport layer may comprise dual layers or multiple layers with different concentration of charge transporting components.

In embodiments where the CTL comprises dual or multiple layers, as illustrated in FIGS. 3 and 4, the first layer (20L and 20P, respectively) typically comprises a film forming polymer, such as a polycarbonate, and a charge transport compound. The next layer (20T and 20R, respectively) then comprises a charge transport compound and a polymer blend comprising a low surface energy polymer and a film forming polymer. Although the layers may have the same composition, generally the weight ratio of low surface energy polymer to film forming polymer increases continuously as the layer rises towards the surface of the imaging member. This imparts the more lubricity to the imaging member surface. In addition, the weight ratio of charge transport compound to polymer (both low surface energy polymer and film forming polymer) may decrease stepwise in each layer as the layer rises towards the surface of the imaging member, so that the lowest weight ratio is present in the outermost exposed layer. For example, the first layer 20P of FIG. 4 comprises a film forming polymer and charge transport compound, but no low surface energy polymer). The intermediate layers 20R comprise charge transport compound and a polymer blend comprising low surface energy polymer and film forming polymer, wherein the weight percent of low surface energy polymer in each layer would vary from about 10 to about 70 weight percent based on the total weight of the polymer blend for each layer, with the weight percent of the low surface energy polymer increases in each layer that is added. In the outermost last layer 20S, the polymer blend would comprise from about 70 to about 95 weight percent low surface energy polymer. The outermost charge transport layer (20T and 20S, respectively) may also be of binary composition, comprising only the low surface energy polymer and a charge transport compound, and no film forming polymer, to achieve minimum surface energy and maximum surface lubricity.

Other layers such as conventional ground strip layer 45 including, for example, conductive particles dispersed in a film forming binder may be applied to one edge of the imaging member to promote electrical continuity to the conductive layer 12. The ground strip layer 45 may include any suitable film forming polymer binder and electrically conductive particles. Typical ground strip materials include those enumerated in U.S. Pat. No. 4,664,995, the entire disclosure of which is incorporated by reference herein. The ground strip layer 45 may have a thickness from about 7 micrometers to about 42 micrometers, for example, from about 14 micrometers to about 23 micrometers.

The multilayered, flexible electrophotographic imaging member web stocks fabricated in accordance with the embodiments described herein may be cut into rectangular sheets. Each cut sheet is then brought overlapped at the ends and joined by any suitable means, such as ultrasonic welding, gluing, taping, stapling, or pressure and heat fusing to form a continuous imaging member seamed belt, sleeve, or cylinder.

As an alternative to separate charge transport 20 and charge generation layers 18, a single imaging layer 22 may be employed, as shown in FIG. 2, with other layers of the photoreceptor being formed as described above. The imaging layer 22 may comprise a single electrophotographically active layer capable of retaining an electrostatic charge in the dark during electrostatic charging, imagewise exposure and image development, as disclosed, for example, in U.S. application Ser. No. 10/202,296, filed Jul. 23, 2002, entitled "Imaging Members," by Liang-Bih Lin, et al., published Jan. 29, 2004, as Application No. 2004/0018440. The single imaging layer 22 may include charge transport molecules in a binder, similar to those of the charge transport layer 20 and optionally may also include a charge generating/photoconductive material, similar to those of the layer 18 described above.

The prepared flexible imaging belt may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

The electrophotographic device can be evaluated by printing in a marking engine into which a photoreceptor belt formed according to the exemplary embodiment has been installed. For intrinsic electrical properties it can also be investigated by conventional electrical drum scanners.

For reasons of convenience, the present disclosure is described for electrophotographic imaging members in flexible belt form even though electrostatographic imaging members having similar configurations are also included.

Electrostatographic flexible belt imaging members are well known in the art. Typically, a flexible substrate is provided having an electrically conductive surface. For electrophotographic imaging members, at least one photoconductive layer is applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto an adhesive layer, if present, or directly over the blocking layer, and a charge transport layer is subsequently formed on the charge generation layer. For electrographic imaging members, an electrically insulating dielectric imaging layer is applied to the electrically conductive surface. The substrate may contain an anti-curl backing layer on the side opposite from the side bearing the charge transport layer or dielectric imaging layer to offset thermal contraction mismatch in the layers.

Generally, anti-curl backing layers comprise a polymer and an adhesive dissolved in a solvent and coated on the reverse side of the active photoreceptor. The adhesive may be any known in the art, such as for example, VITEL PE2200 which is available from Bostik, Inc. (Middleton, Mass.). VITEL PE2200 is a copolyester resin of terephthalic acid and isophthalic acid with ethylene glycol and dimethyl propanediol. Any other suitable copolyesters may also be used. The anti-curl backing layer must adhere to the polyethylenenaphthalate (PEN) substrate of the photoreceptor, for the life of the photoreceptor, while being subjected to xerographic cycling over rollers and backer bars within the copier or printer.

For electrographic imaging members, a flexible dielectric layer overlying the conductive layer may be substituted for the active photoconductive layers. Any suitable, conventional, flexible, electrically insulating, thermoplastic dielectric polymer matrix material may be used in the dielectric layer of the electrographic imaging member. If desired, the flexible belts disclosed herein may be used for other purposes where cycling durability is important.

All the patents and applications referred to herein are hereby specifically, and totally incorporated herein by reference in their entirety in the instant specification.

EXAMPLES

The examples set forth hereinbelow are being submitted to illustrate embodiments of the present disclosure. These examples are intended to be illustrative only and are not intended to limit the scope of the present disclosure. Also, parts and percentages are by weight unless otherwise indicated. Comparative examples and data are also provided.

Example 1

Four polymers were obtained from Mitsubishi Gas Chemical Corporation (MGC). The properties, provided by MGC, of the four polymers compared to MAKROLON 5705 manufactured by Farbenfabriken Bayer A. G and PCZ-500 manufactured by MGC are in Table 1

TABLE 1

| Polymer | Monomer used in synthesis | Mw as measured by MGC | Contact Angle with water as measured by MGC |
|---|---|---|---|
| FPC0540UA | BisPhenol –Z | 39500 | 96 |
| FPC0550UA | BisPhenol –Z | 53000 | 95 |
| FPC0580UA | BisPhenol –Z | 75100 | 97 |

TABLE 1-continued

| Polymer | Monomer used in synthesis | Mw as measured by MGC | Contact Angle with water as measured by MGC |
|---|---|---|---|
| FPC0170UA | BisPhenol –A | 68200 | 98 |
| Control PCZ-500 | BisPhenol –Z | 52900 | 90 |
| Control MAKROLON 5705 | BisPhenol –A | 66900 | 89 |

Control Example 2

An imaging member was prepared by providing a 0.02 micrometer thick titanium layer coated on a biaxially oriented polyethylene naphthalate substrate (KALEDEX 2000) having a thickness of 3.5 mils. Applied thereon with a gravure applicator, was a solution containing 50 grams 3-amino-propyltriethoxysilane, 41.2 grams water, 15 grams acetic acid, 684.8 grams of 200 proof denatured alcohol and 200 grams heptane. This layer was then dried for about 2 minutes at 120° C. in the forced air drier of the coater. The resulting blocking layer had a dry thickness of 500 Angstroms.

An adhesive layer was then prepared by applying a wet coating over the blocking layer, using a gravure applicator, containing 0.2 percent by weight based on the total weight of the solution of polyarylate adhesive (ARDEL D100 available from Toyota Hsutsu Inc.) in a 60:30:10 volume ratio mixture of tetrahydrofuran/monochlorobenzene/methylene chloride. The adhesive layer was then dried for about 2 minutes at 120° C. in the forced air dryer of the coater. The resulting adhesive layer had a dry thickness of 200 angstroms.

A charge generation layer dispersion was prepared by introducing 0.45 grams of IUPILON 200 (PCZ-200) available from Mitsubishi Gas Chemical Corporation and 50 ml of tetrahydrofuran into a 4 oz. glass bottle. To this solution was added 2.4 grams of hydroxygallium phthalocyanine and 300 grams of ⅛ inch (3.2 millimeter) diameter stainless steel shot. This mixture was then placed in a ball mill for 8 hours. Subsequently, 2.25 grams of PCZ-200 was dissolved in 46.1 gm of tetrahydrofuran, and added to this HOGaPc slurry. This slurry was then placed in a shaker for 10 minutes. The resulting slurry was, thereafter, applied to the adhesive interface with a Bird applicator to form a charge generation layer having a wet thickness of 0.25 mil. The charge generation layer was dried at 120° C. for 1 minute in a forced air oven to form a dry charge generation layer having a thickness of 0.4 micrometer.

This charge generation layer was overcoated with a charge transport layer. The charge transport layer was prepared by introducing into an amber glass bottle in a weight ratio of 50:50 N,N'-diphenyl-N,N'-bis(3-methylphenyl)-biphenyl-4,4-diamine and MAKROLON™ 5705. The resulting mixture was dissolved in methylene chloride to form a solution containing 15 percent by weight solids. This solution was applied on the charge generating layer using a Bird applicator to form a coating which upon drying had a thickness of 29 microns. During this coating process, the humidity was equal to or less than 15 percent.

Control Example 3

A photoreceptor was prepared as in Example 2 except the charge generating layer was overcoated with a first charge transport layer. The first charge transport layer was prepared by introducing into an amber glass bottle in a weight ratio of 50:50 N,N'-diphenyl-N,N'-bis(3-methylphenyl)-biphenyl-4,4-diamine and MAKROLON™ 5705. The resulting mixture was dissolved in methylene chloride to form a solution containing 15 percent by weight solids. This solution was applied on the charge generating layer using a Bird applicator to form a coating which upon drying had a thickness of 14.5 microns. During this coating process the humidity was equal to or less than 15 percent.

This first charge transport layer was then overcoated with a second charge transport layer. The second charge transport layer was prepared by introducing into an amber glass bottle in a weight ratio of 50:50 N,N'-diphenyl-N,N'-bis(3-methylphenyl)-biphenyl-4,4-diamine and MAKROLON™ 5705. The resulting mixture was dissolved in methylene chloride to form a solution containing 15 percent by weight solids. This solution was applied on the charge generating layer using a Bird applicator to form a coating which upon drying had a thickness of 14.5 microns. During this coating process the humidity was equal to or less than 15 percent.

Example 4

A photoreceptor was prepared as in Example 2 except the charge transport layer was prepared by making a solution of 50:50 N,N'-diphenyl-N,N'-bis(3-methylphenyl)-biphenyl-4,4-diamine and modified polycarbonate FPC0580UA dissolved in methylene chloride. This solution was applied on the charge generating layer using a Bird applicator to form a coating which upon drying had a thickness of 29 microns. During this coating process, the humidity was equal to or less than 15 percent. Each charge transport layer was compared to the control sample made with MAKROLON 5705.

Example 5

A photoreceptor was prepared as in Example 2 except that the modified polycarbonate used was FPC0170UA available from Mitsubishi Gas Chemical Corporation.

Example 6

A photoreceptor was prepared as in Example 3 except that the polymer used in the second charge transport layer was modified polycarbonate FPC0580UA available from Mitsubishi Gas Chemical Corporation.

Example 7

A photoreceptor was prepared as in Example 3 except that the polymer used in the second charge transport layer was modified polycarbonate FPC0170UA available from Mitsubishi Gas Chemical Corporation.

Example 8

The viscosity of the solutions used to fabricate the charge transport layers in Examples 2, 4 and 5 was measured using a Brookfield DV-II+ viscometer. The measurement was made using a #2 spindle at a spindle speed of 30 RPM. Results are given in Table 2.

TABLE 2

| Example # | Viscosity Centipoise |
|---|---|
| Control Example 2 | 546 |
| Example 4 | 920 |
| Example 5 | 613 |

The coefficient for friction of Examples 3, 6 and 7 was measured using a DYNISCO 5095D coefficient of friction tester. The results of these tests are listed in the following Table 3.

TABLE 3

| Charge Transport Layer | Coefficient of Friction |
|---|---|
| Control Example 3 | 0.42 |
| Example 6 | 0.35 |
| Example 7 | 0.35 |

As shown in Table 2, the charge transport layers in Examples 3 and 4 give a solution viscosity within the range necessary for defect free coatings by extrusion. The two inventive examples in Table 3 give lower coefficient of friction than the control example.

The charge transport layer of the photoconductive imaging members of Control Examples 2 and 3 and Examples 4, 5, 6 and 7 were also evaluated for adhesive properties and demonstrated to have infinite adhesion, as the sampled charge transport layers would not peel away from the substrate.

The flexible photoreceptor sheets prepared as described in Examples 3, 6, and 7 were tested for their xerographic sensitivity and cyclic stability in a scanner. In the scanner, each photoreceptor sheet to be evaluated was mounted on a cylindrical aluminum drum substrate, which was rotated on a shaft. The devices were charged by a corotron mounted along the periphery of the drum. The surface potential was measured as a function of time by capacitatively coupled voltage probes placed at different locations around the shaft. The probes were calibrated by applying known potentials to the drum substrate. Each photoreceptor sheet on the drum was exposed to a light source located at a position near the drum downstream from the corotron. As the drum was rotated, the initial (pre-exposure) charging potential (Vddp) was measured by a first voltage probe. Further rotation lead to an exposure station, where the photoreceptor device was exposed to monochromatic radiation of a known intensity of 3.5 ergs/cm$^2$ to obtain Vbg. The devices were erased by a light source located at a position upstream of charging to obtain Vr. The measurements illustrated in Table 4 below include the charging of each photoconductor device in a constant current or voltage mode. The devices were charged to a negative polarity corona. The surface potential after exposure (Vbg) was measured by a second voltage probe. In the design, the exposure could be turned off in certain cycles. The voltage measured at the second probe is then Vddp. The voltage generally is higher at the charging station. The difference between the charged voltage at the charging station and the Vddp is dark decay. The devices were finally exposed to an erase lamp of appropriate intensity and any residual potential (Vr) was measured by a third voltage probe. After 10,000 charge-erase cycles, the Vbg was remeasured and the difference between Vbg for the first cycle and Vbg for cycle 10,000 (ΔVbg 10K) was computed.

TABLE 4

| Example | Vbg (initial) 3.5 erg/cm$^2$; Vddp = 500 | Vbg (10 k) 3.5 erg/cm$^2$; Vddp = 500 | Vresidual (300 erg/cm$^2$) | Dark Decay |
|---|---|---|---|---|
| Control 3 | 68 | 113 | 34 | −130 |
| 6 | 79 | 150 | 43 | −126 |
| 7 | 68 | 125 | 39 | −142 |

The two inventive samples exhibit similar xerographic properties to the control.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An electrostatographic imaging member comprising:

a substrate having a first and second side, wherein the substrate has a conductive surface;

an imaging layer disposed on the first side of the substrate, wherein the imaging layer comprises:

a charge generating layer and, a charge transport layer disposed on the charge generating layer comprising a charge transport compound and a polymeric binder formed from a monomer selected from the group consisting of modified Bisphenol A polycarbonate poly(4,4'-isopropylidene diphenyl carbonate), modified Bisphenol Z polycarbonate poly (4,4'-diphenyl-1-1'cyclohexane carbonate), and mixtures thereof, wherein the charge transport layer has a bottom layer, one or more intermediate layers, and an outermost layer and further wherein weight percent of the polymeric binder to the charge transport compound in the one or more intermediate layers increases in the direction of the bottom layer to the outermost layer, the weight percent of the outermost layer being greater than the weight percent of every other intermediate layer; and an anti-curl backing layer disposed on the second side of the substrate, wherein the anti-curl backing layer comprises an adhesive promoter.

2. The electrostatographic imaging member of claim 1, wherein the polymeric binder is a low surface energy modified polycarbonate polymer having a viscosity-molecular weight of from about 20,000 to about 150,000.

3. The electrostatographic imaging member of claim 1, wherein surface energy of the electrostatographic imaging member as measured by a contact angle of the imaging layer with water is greater than 90 degrees.

4. The electrostatographic imaging member of claim 1, wherein the polymeric binder has a coefficient of friction of about equal to or less than 0.35.

5. The electrostatographic imaging member of claim 1, wherein the polymer binder is present in an amount of from about 30% to about 70% by weight of total weight of the imaging layer.

6. The electrostatographic imaging member of claim 1, wherein the charge transport layer includes a top and bottom layer, the top and bottom layer being in contact with the charge generating layer.

7. The electrostatographic imaging member of claim 6, wherein the polymeric binder is entirely contained within the top layer.

8. The electrostatographic imaging member of claim 6, wherein the bottom layer is selected from the group consisting of poly(4,4'-isopropylidene diphenyl)carbonate and poly (4,4'-diphenyl-1,1'-cyclohexane)carbonate.

9. The electrostatographic imaging member of claim 6, wherein the bottom layer has a higher weight ratio of charge transport compound than the top layer by total weight of the charge transport layer.

10. The electrostatographic imaging member of claim 1, wherein the bottom layer is selected from the group consisting of poly(4,4'-isopropylidene diphenyl)carbonate and poly (4,4'-diphenyl-1,1'-cyclohexane)carbonate.

11. The electrostatographic imaging member of claim 1, wherein the bottom layer has a higher weight ratio of charge transport compound than the top layer by total weight of the charge transport layer.

12. The electrostatographic imaging member of claim 1, wherein there are from 1 to 10 intermediate layers.

13. An electrostatographic imaging member comprising:

a substrate having a first and second side, wherein the substrate has a conductive surface;

a charge transport layer disposed on the first side of the substrate, wherein the charge transport layer comprises:

a charge transport component and a polymeric binder formed from a monomer selected from the group consisting of modified Bisphenol A polycarbonate poly (4,4'-isopropylidene diphenyl carbonate), modified Bisphenol Z polycarbonate poly (4,4'-diphenyl-1-1'cyclohexane carbonate), and mixtures thereof, wherein the charge transport layer has a bottom layer, one or more intermediate layers, and an outermost layer and further wherein weight percent of the polymeric binder to the charge transport compound in the one or more intermediate layers increases in the direction of the bottom layer to the outermost layer, the weight percent of the outermost layer being greater than the weight percent of every other intermediate layer; and an anti-curl backing layer disposed on the second side of the substrate, wherein the anti-curl backing layer comprises an adhesive promoter.

14. The electrostatographic imaging member of claim 13, wherein the polymeric binder is a low surface energy modified polycarbonate polymer having a viscosity-molecular weight of from about 20,000 to about 150,000.

15. The electrostatographic imaging member of claim 13, wherein the polymer binder is present in an amount of from about 30% to about 70% by weight of total weight of the imaging layer.

16. The electrostatographic imaging member of claim 13 further including a charge generating layer.

17. An image forming apparatus for forming images on a recording medium comprising:

a) an electrostatographic imaging member having a charge retentive-surface to receive an electrostatic latent image thereon, wherein the electrostatographic imaging member comprises a substrate having a first and second side, wherein the substrate has a conductive surface, an imaging layer disposed on the first side of the substrate, wherein the imaging layer comprises a polymeric binder formed from a monomer selected from the group consisting of modified Bisphenol A polycarbonate poly(4,4'-isopropylidene diphenyl carbonate), modified Bisphenol Z polycarbonate poly (4,4'-diphenyl-1-1'cyclohexane carbonate), and mixtures thereof, wherein the charge transport layer has a bottom layer, one or more intermediate layers, and an outermost layer and further wherein weight percent of the polymeric binder to the charge transport compound in the one or more intermediate layers increases in the direction of the bottom layer to the outermost layer, the weight percent of the outermost layer being greater than the weight percent of every other intermediate layer, and an anti-curl backing layer disposed on the second side of the substrate, wherein the anti-curl backing layer comprises an adhesive promoter;

b) a development member for applying a developer material to the charge-retentive surface to develop the electrostatic latent image to form a developed image on the charge-retentive surface;

c) a transfer member for transferring the developed image from the charge-retentive surface to an intermediate transfer member or a copy substrate; and d) a fusing member for fusing the developed image to the copy substrate.

18. The electrostatographic imaging member of claim 17, wherein the polymeric binder is a low surface energy modified polycarbonate polymer having a viscosity-molecular weight of from about 20,000 to about 150,000.

19. The electrostatographic imaging member of claim 17, wherein the imaging layer is a charge transport layer.

20. The electrostatographic imaging member of claim 17, wherein the polymer binder is present in an amount of from about 30% to about 70% by weight of total weight of the imaging layer.

21. The electrostatographic imaging member of claim 17, wherein surface energy of the electrostatographic imaging member as measured by the contact angle of the imaging layer with water is greater than 90 degrees.

* * * * *